US008801583B1

(12) United States Patent
Shenkin

(10) Patent No.: US 8,801,583 B1
(45) Date of Patent: Aug. 12, 2014

(54) SYSTEMS AND METHODS FOR AN EXERCISE MECHANISM

(71) Applicant: Ronald Robert Shenkin, Osprey, FL (US)

(72) Inventor: Ronald Robert Shenkin, Osprey, FL (US)

( * ) Notice: Subject to any disclaimer, the term of this patent is extended or adjusted under 35 U.S.C. 154(b) by 0 days.

(21) Appl. No.: 14/098,479

(22) Filed: Dec. 5, 2013

(51) Int. Cl.
*A63B 21/02* (2006.01)
*A63B 21/00* (2006.01)

(52) U.S. Cl.
USPC ..... 482/124; 482/126; 482/133

(58) Field of Classification Search
CPC ..... A63B 21/02–21/0557
USPC ..... 482/121–126, 129–130, 133, 142; 473/424, 458; 5/625–629
See application file for complete search history.

(56) References Cited

U.S. PATENT DOCUMENTS 5,820,533 A * 10/1998 Goldman ..... 482/124
5,916,070 A * 6/1999 Donohue ..... 482/74
7,628,742 B2 * 12/2009 Weaver ..... 482/125

* cited by examiner

*Primary Examiner* — Loan H Thanh
*Assistant Examiner* — Jennifer M Deichl
(74) *Attorney, Agent, or Firm* — Inventions International Inc.; Tiffany C. Miller

(57) ABSTRACT

An exercise apparatus has a plate with a primary side located opposite a secondary side. The primary side of the plate is supported by a user's torso. The plate has at least one portion flaring at an angle between 0 degrees and 60 degrees in relation to the plate. The plate has a primary opening and a secondary opening that receives a securing strap configured to secure the plate to a user's torso. The secondary side of the plate has at least one protruding structure that has an opening being substantially perpendicular to a user's torso when the plate is secured to a user's torso. The opening receives a pliable material that has a primary end located opposite a secondary end. The primary end has a primary grip and the secondary end has a secondary grip. The primary grip and the secondary grip are grasped by a user.

3 Claims, 7 Drawing Sheets

SYSTEMS AND METHODS FOR AN EXERCISE MECHANISM

BACKGROUND OF THE INVENTION

1. Field of the Invention

The present invention relates, generally, to an exercise apparatus having a plate adapted to receive a resistance band. More particularly, it relates to a plate having a securing strap that can be attached to a user's torso and having at least one protruding structure with an opening to receive a pliable material for a user to grasp and to perform a range of motions.

2. Background Art

Some prior art exercise equipment such as resistance bands need to be anchored to a stationary household object for the specific exercise being performed. The resistance band can be anchored to different locations for each different muscle group being targeted. For instance, the resistance band can be attached to a door for a user to perform lateral pull-downs or tricep pushdowns. The resistance band can be wrapped around a pole for chest exercises or shoulder rotations. It is time consuming and disruptive to a user's focus when a user is required to find a new location to reposition the resistance band when targeting different muscle groups. In addition, a user may not have a stationary object such as a door or a pole available to perform some of the exercises. Thus, there is a need for an improved anchoring system for a resistance band that does not require a user to attach the resistance band to multiple household objects.

Other resistance band exercises require a user to stand on the resistance band and grip the handles for bicep curls or overhead presses. Users with restricted movement such as individuals in wheel chairs or those confined to a bed or a chair do not have the ability to stand on the resistance band. Thus, there is a need for a resistance band anchoring system that can provide a stable platform for resistance exercise without the need for a user to stand on the resistance band.

Prior art resistance bands can make an exercise routine difficult when another person acts as an anchor by holding a portion of the resistance band. Finding a person that is willing to act as an anchor for a resistance band can be burdensome and inconvenient. Also, a person acting as an anchor cannot provide a stable enough anchoring system because the person may fatigue or accidentally release the resistance band during use. Thus, there is a need for a more reliable resistance band anchoring system that provides a user with support and stability to a user's back and spine during a workout with a resistance band.

Prior art resistance bands can be attached to exercise machines in a gym. These exercise machines are expensive, bulky, and are not practical to transport. Also, many people do not have the opportunity to resistance train or to rehabilitate in a gym setting. Some users prefer to exercise outdoors or at an in-home setting. Hence, there is a need for a resistance band anchoring system that is not bulky and is easily portable so that a user can perform resistance exercises in a variety of settings. This is more desirable for a user to be able to quickly and efficiently exercise without having to take the time to travel to an exercise facility.

There are several challenges to overcome with resistance training or rehabilitation with free weights. One challenge being the need for a lightweight, portable exercise system that can be used by a variety of users including, but not limited to, range of motion exercises for the elderly, rehabilitation exercises for those recovering from an injury, exercises for traveling individuals that want to stay in shape, or resistance training for athletes. The problem with the use of prior art free weights is that the heaviness associated with free weights makes them difficult to travel with and to lift. Thus, there is a need for an improved light weight resistance system that would allow a variety of users to easily transport the resistance system to different locations for use.

However, in view of the prior art considered as a whole at the time the present invention was made; it was not obvious to those of ordinary skill in the pertinent art how the identified needs could be fulfilled.

SUMMARY OF THE INVENTION

The long-standing but heretofore unfulfilled need for an exercise apparatus with a plate that is adapted to have a securing strap to attach to a user's torso and having a protruding structure with an opening to receive a pliable material in which a user can grasp an end of the pliable material and perform a range of motions with varying resistance levels which also includes improvements that overcome the limitations of prior art resistance band devices, is now met by a new, useful, and non-obvious invention.

The novel exercise apparatus has a plate having a primary side located opposite a secondary side. The plate is of a ridged material including, but not limited to, metal, plastic, or wood. The primary side of the plate is supported by a user's torso. It is a preferred embodiment for the plate to be contacting a user's back. In an alternate embodiment, the plate can be located against a user's chest or abdominal cavity. It is within the scope of this invention for the plate to contact a user's shirt, jacket, a gown, a paper gown, a piece of foam, or any other barrier or material that may be located between a user's back and the plate. The plate has a primary opening and a secondary opening that receives a securing strap configured to secure the plate to a user's torso. The securing strap includes, but is not limited to, a belt. The securing strap has a primary end located opposite a secondary end. Both the primary end and secondary end have an attaching element including, but not limited to, a plurality of hook and loop attachments, a buckle, a button, a snap, or a fastener. The attaching element connects the primary end and the secondary end of the securing strap around a user's torso including, but not limited to, around a user's waist. It is also within the scope of this invention for the securing strap to be tied around a user's torso. It is envisioned that the exercise apparatus can be easily stored by being mounted on a wall. An opening located on the plate is adapted to receive including, but not limited to, a wall hook, a nail, or a length of material.

The secondary side of the plate has at least one protruding structure including, but not limited to, a ring. The protruding structure has an opening being substantially perpendicular to a user's torso when the plate is secured to a user's torso. The opening receives a pliable material. The securing strap can have an opening to receive the protruding structure. In an alternate embodiment, the secondary side of the plate can have a plurality of protruding structures each having an opening to receive a pliable material, the opening is substantially perpendicular to a user's torso when the plate is attached to a user's torso. A plurality of protruding structures allows a user the ability to position the pliable material at differing locations on the plate.

The pliable material includes, but is not limited to, a bungee cord, a cord, a flat band or a tube. The pliable material can be made of including, but not limited to, plastic, rubber, or neoprene. The pliable material has a primary end located opposite a secondary end. The primary end has a primary grip and the secondary end has a secondary grip. The primary grip and the secondary grip are of a length of pliable material at any point where the pliable material is gripped by a user. The primary end and secondary end can have additional material beyond the point where the ends are gripped. It is within the scope of this invention for the grip of the pliable material to include, but not be limited to, a portion of the pliable material that a user grips with their hand. It is also envisioned that the grip includes, but is not limited to, a handle or a loop. A grip can be grasped by a user's extremities such as a user's hands. Additionally, a loop can receive a user's extremities such as a user's wrists or a user's wrist and a user's ankle. It is a preferred embodiment that the grip can be adjustable along the length of the pliable material. For instance, a grip can be adjustable along the length of pliable material to correspond to the arm span or leg span of a user.

The primary grip is configured to be contacted by a user's primary extremity and the secondary grip is configured to be contacted by a user's secondary extremity. It is a preferred embodiment that a primary extremity and a secondary extremity include, but are not limited by, a user's hands, a user's feet, a leg and an arm, or a foot and a hand. A user's extremity is a limb including, but not limited to, an arm, a hand, a wrist, an ankle, a thigh, a leg, or a foot. The pliable material has a length great enough for a user's primary extremity to contact the primary grip and a user's secondary extremity to contact the secondary grip when the primary side of the plate is supported by a user's torso.

The novel invention also includes an improved exercise apparatus having the preferred embodiment of a plate with a lower portion flaring at an angle between 0 degrees and 60 degrees in relation to the plate. More particularly, a user can catch hold of the lower portion of the plate with the pliable material. The pliable material is positioned against the lower portion of the plate to facilitate the exercise motions including, but not limited to, curls, overhead press, and tricep extensions. It is within the scope of this invention for the exercise apparatus to have a plate with at least one portion flaring at an angle between 0 degrees and 60 degrees in relation to the plate including, but not limited to a top portion, a bottom portion, or a side portion (not shown).

In addition to the aforesaid embodiments of the exercise apparatus, the exercise plate includes multiple additional improvements as well.

Another improvement includes a preferred embodiment of the exercise apparatus having a plate with at least one recess located on a perimeter of the plate. A user can position the pliable material to be captured by at least one recess. The at least one recess stabilizes the pliable material at a specific position along the perimeter of the plate and prevents the pliable material from sliding along the perimeter of the plate when a user is performing a range of motions with the pliable material in hand. The at least one recess facilitates the ideal placement of the pliable material for a user to accomplish a variety of resistance techniques. When at least one recess is located on either side of the plate, the pliable material can be aligned by a user to target specific muscle groups including, but not limited to, chest and arms. More particularly, a user can practice a golf swing motion and bench press when the pliable material is supported by at least one recess located on the side of the plate. It is within the scope of this invention for a plurality of recesses to be located on the perimeter of the plate. It is also envisioned that the novel exercise apparatus does not have a recess located on the perimeter of the plate.

Another improvement includes the exercise apparatus having a plate with a securing strap to attach to the torso of a user. The securing strap supports a user's torso and positions a user's torso so a user is not twisting or bending at their torso while performing a range of motions with the exercise apparatus. This reduces incidents of injury and promotes a more efficient workout.

In a preferred embodiment, a method of operating an exercise apparatus having a plate begins with providing a user with a plate having a primary side located opposite a secondary side. Connecting a securing strap through at least one opening associated with the plate. Securing the primary side of the plate to a user's torso. Attaching the securing strap to the user's torso. Providing a pliable material to be received through an opening of at least one structure protruding from the secondary side of the plate. A user inserting a pliable material through the opening. The opening being substantially perpendicular to the user's torso when the plate is attached to a user's torso. A user's primary extremity contacting a primary grip and a user's secondary extremity contacting a secondary grip. The primary grip is located on a primary end of the pliable material and the secondary grip is located on a secondary end of the pliable material. The pliable material is manipulated by a user's force when the user's primary extremity and secondary extremity perform a range of motions.

Another important object is to provide a method of operating an exercise apparatus having a plate where a user can select a pliable material from a plurality of pliable materials having differing resistance levels. The differing resistance levels correspond to the pliability of the pliable material and include, but are not limited to, very stretchy, stretchy, stiff, or very stiff. The user can identify the plurality of pliable materials having differing resistance levels by a visual cue. The visual cue includes, but is not limited to, a color, a stripe, a number, or a letter. For instance, the stretchy pliable material can have one stripe and the stiff pliable material can have two stripes.

Another important object is to provide a method of operating an exercise apparatus having a plate where a user can select a pliable material from a plurality of pliable materials having differing lengths. The user can identify the plurality of pliable materials having differing lengths by a visual cue. The visual cue includes, but is not limited to, a color, a stripe, a number, or a letter. For instance, the short pliable material can have the letter "S" and the long pliable material can have the letter "L".

Additional objects include the provision of an exercise apparatus having a plate with a securing strap configured to attach to a user, at least one recess located on the perimeter of the plate to capture a pliable material, at least one protruding structure having an opening substantially perpendicular to a user's torso, the opening adapted to receive a pliable material, a plurality of pliable materials having differing resistance levels and lengths that can be interchangeably received by the at least one protruding structure opening, the pliable material having adjustable grips, and the plate having at least one portion configured to have an angle between 0 degrees and 60 degrees in relation to the plate.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of this invention.

Figure 1:
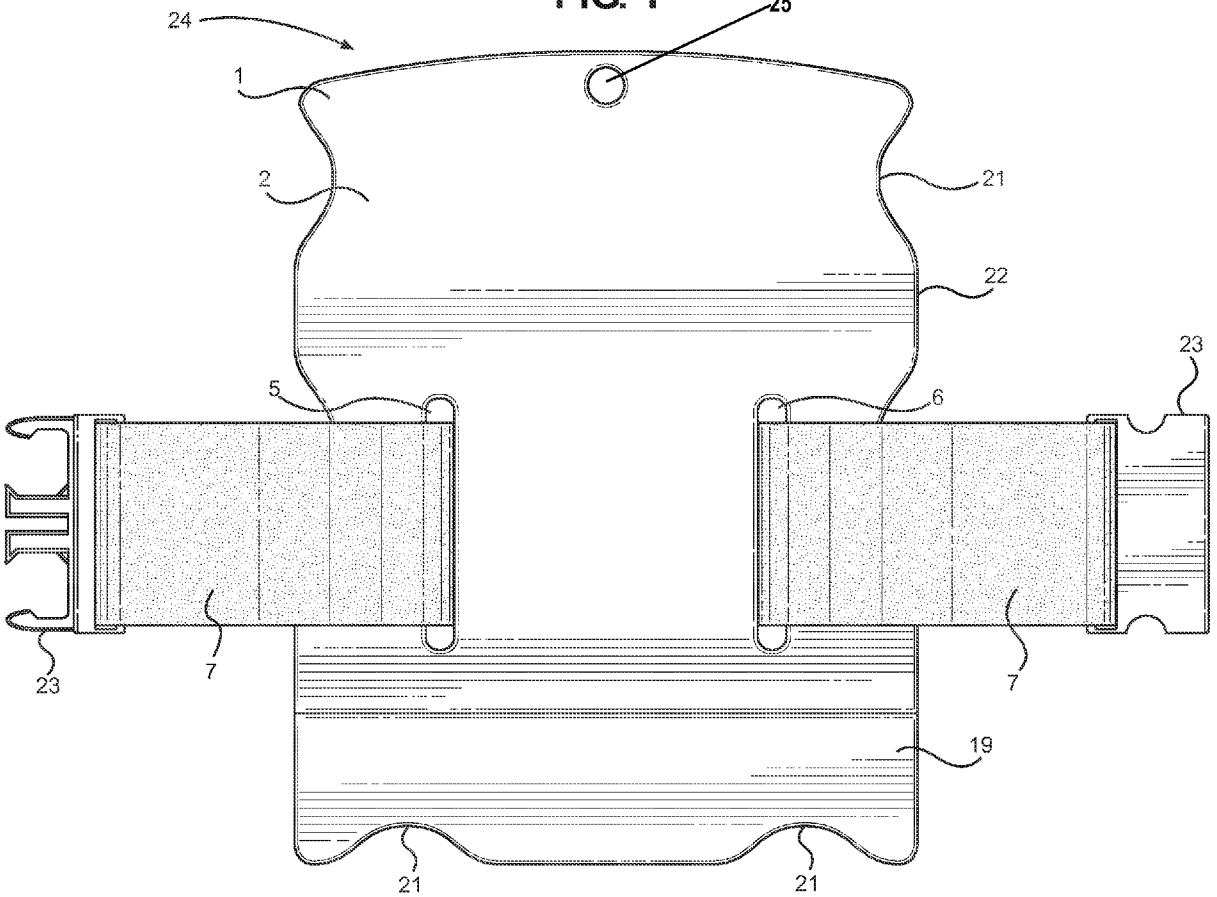
FIG. 1 is a front perspective view of the novel exercise apparatus having a plate with a securing strap.
Figure 4:
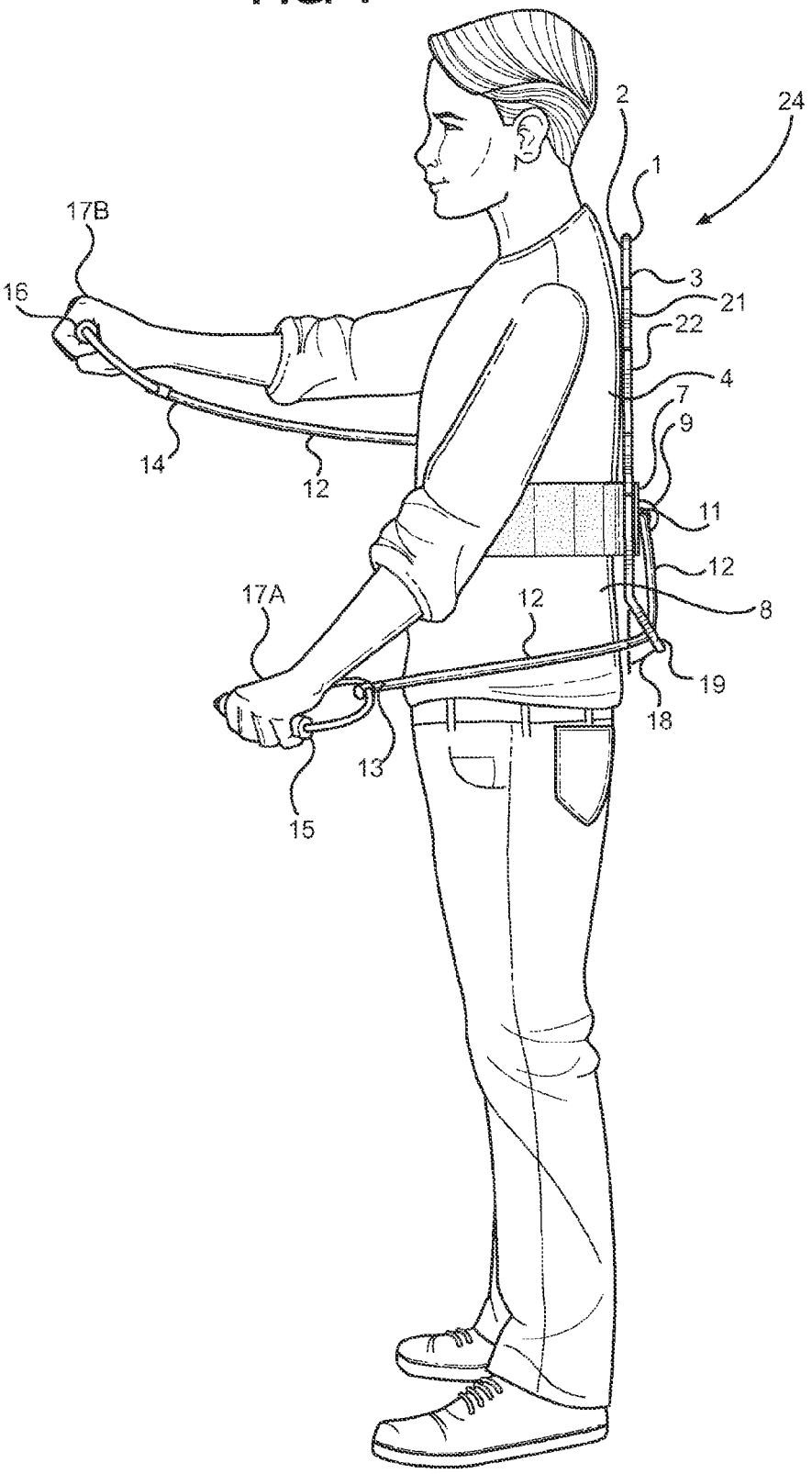
FIG. 4 is a side view of the novel exercise apparatus with a plate having a primary side supported by a user's torso.

In a preferred embodiment, FIG. 1 shows exercise apparatus 24 having plate 1 with primary opening 5 and secondary opening 6. Primary side 2 of plate 1 is configured to contact a user's back (not shown). At least one recess 21 is located on a perimeter 22 of plate 1. Securing strap 7 is received by primary opening 5 and secondary opening 6. Securing strap 7 attaches to a user's torso (not shown) with attaching element 23. Plate 1 has at least one portion 19 flaring at an angle between 0 degrees and 60 degrees 18 (FIGS. 4 and 6-7) in relation to plate 1. Plate 1 has opening 25 adapted to receive including, but not limited to, a wall hook, a nail, or a length of material (not shown).

Figure 2:
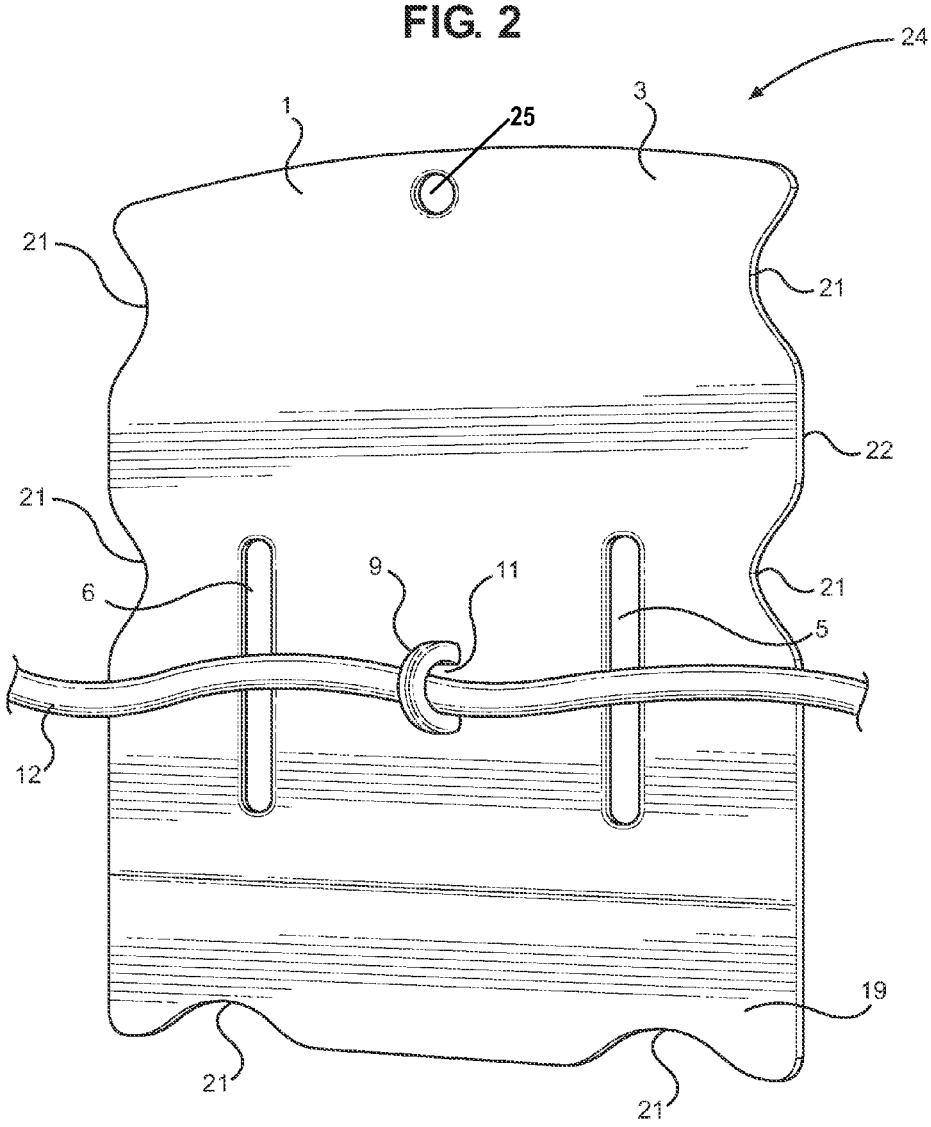
FIG. 2 is a rear perspective view of the novel exercise apparatus having a plate with at least one protruding structure.
Figure 3:
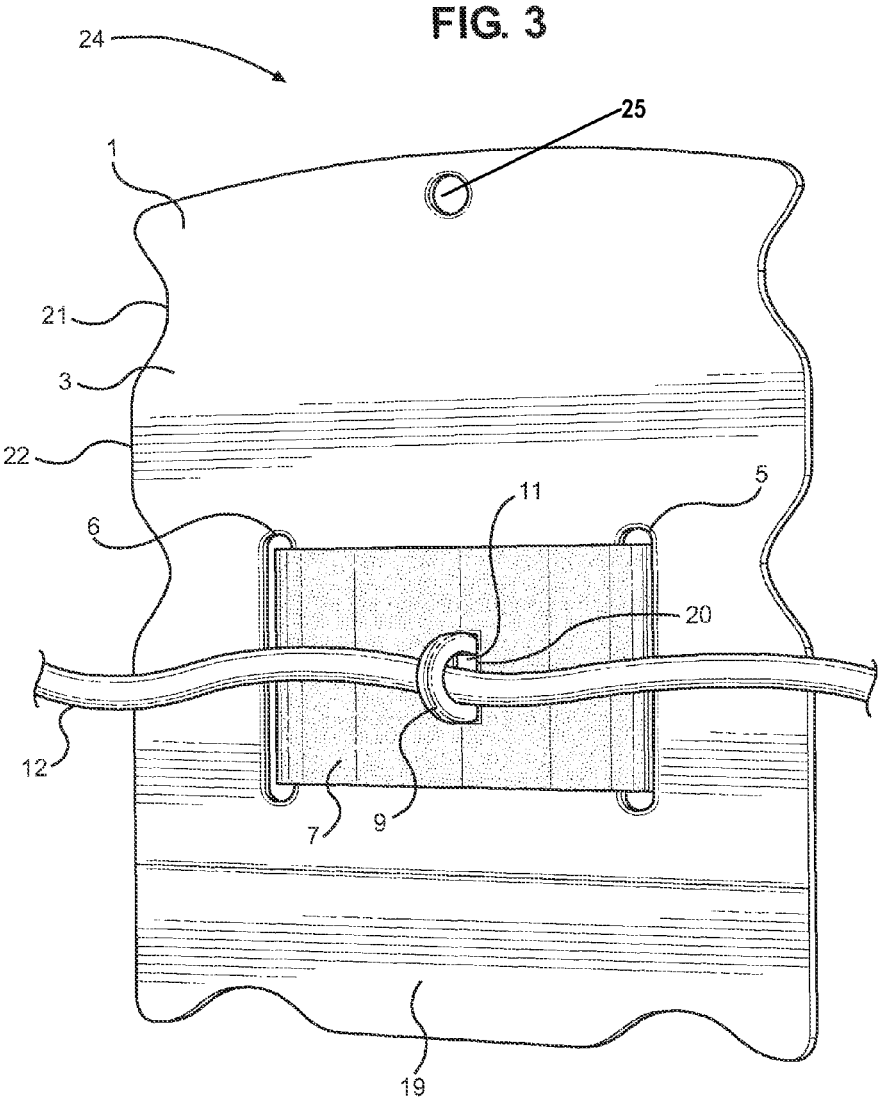
FIG. 3 is a rear perspective view of the novel exercise apparatus having a plate with a securing strap and a pliable material.
Figure 5:
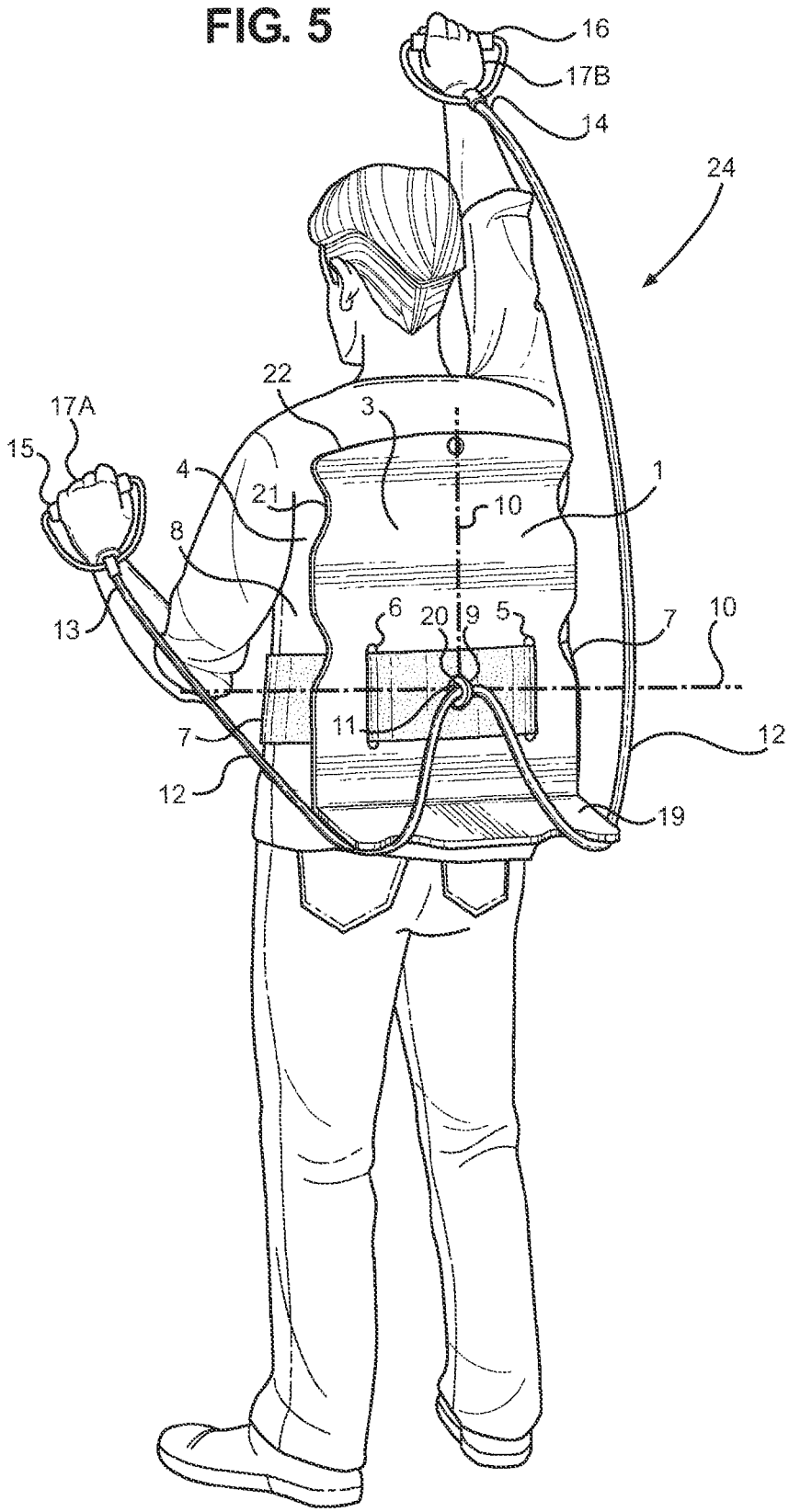
FIG. 5 is a rear perspective view of the novel exercise apparatus having a plate secured to a user's torso and a user's hands grasping a handle located on an end of the pliable material.
Figure 6:
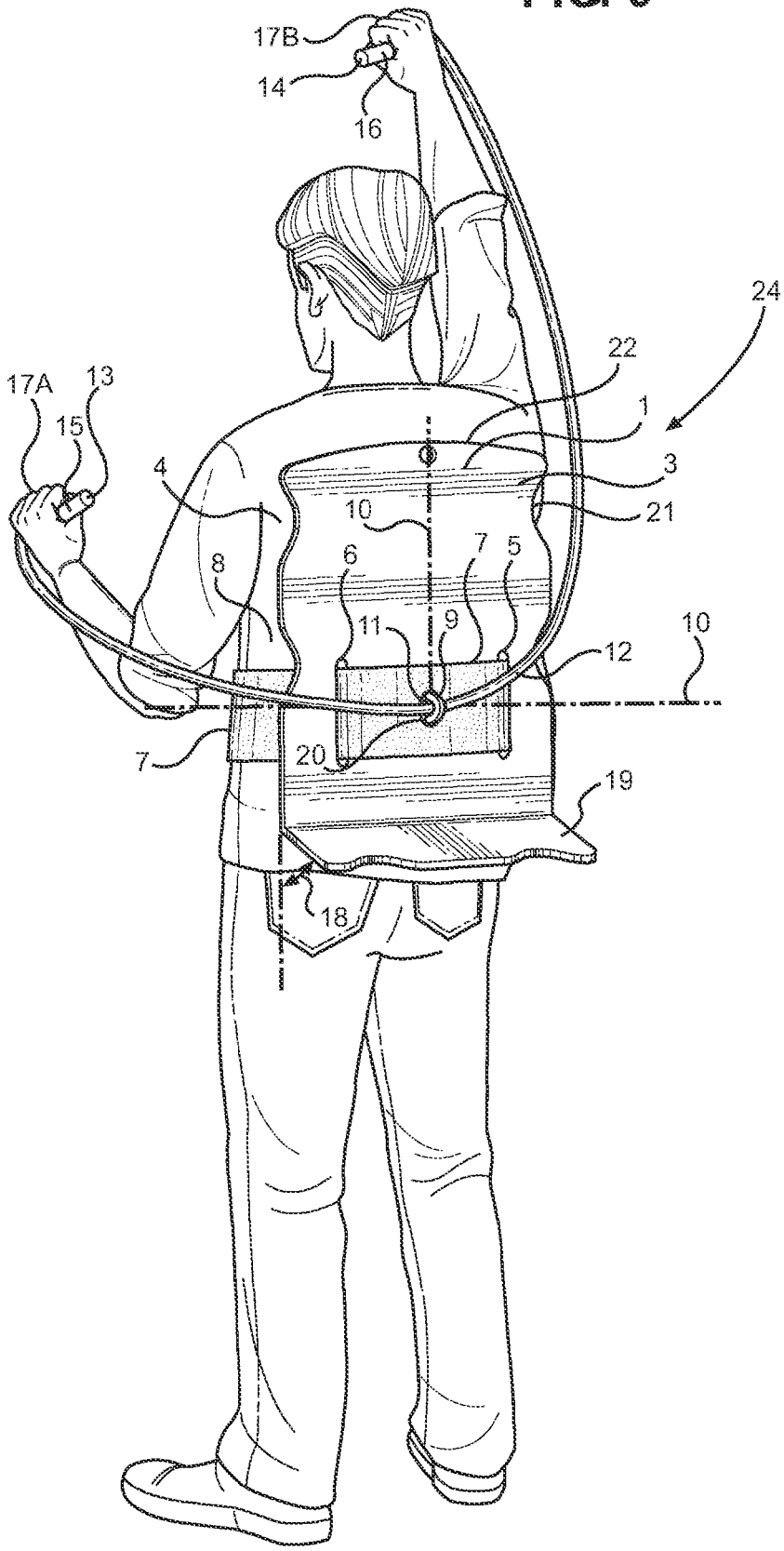
FIG. 6 is a rear perspective view of the novel exercise apparatus having a plate secured to a user's torso and a user's hands grasping a grip located on an end of the pliable material; and, FIG. 7 is a rear perspective view of the novel exercise apparatus having a plate with at least one portion flaring at an angle between 0 degrees and 60.
Figure 7:
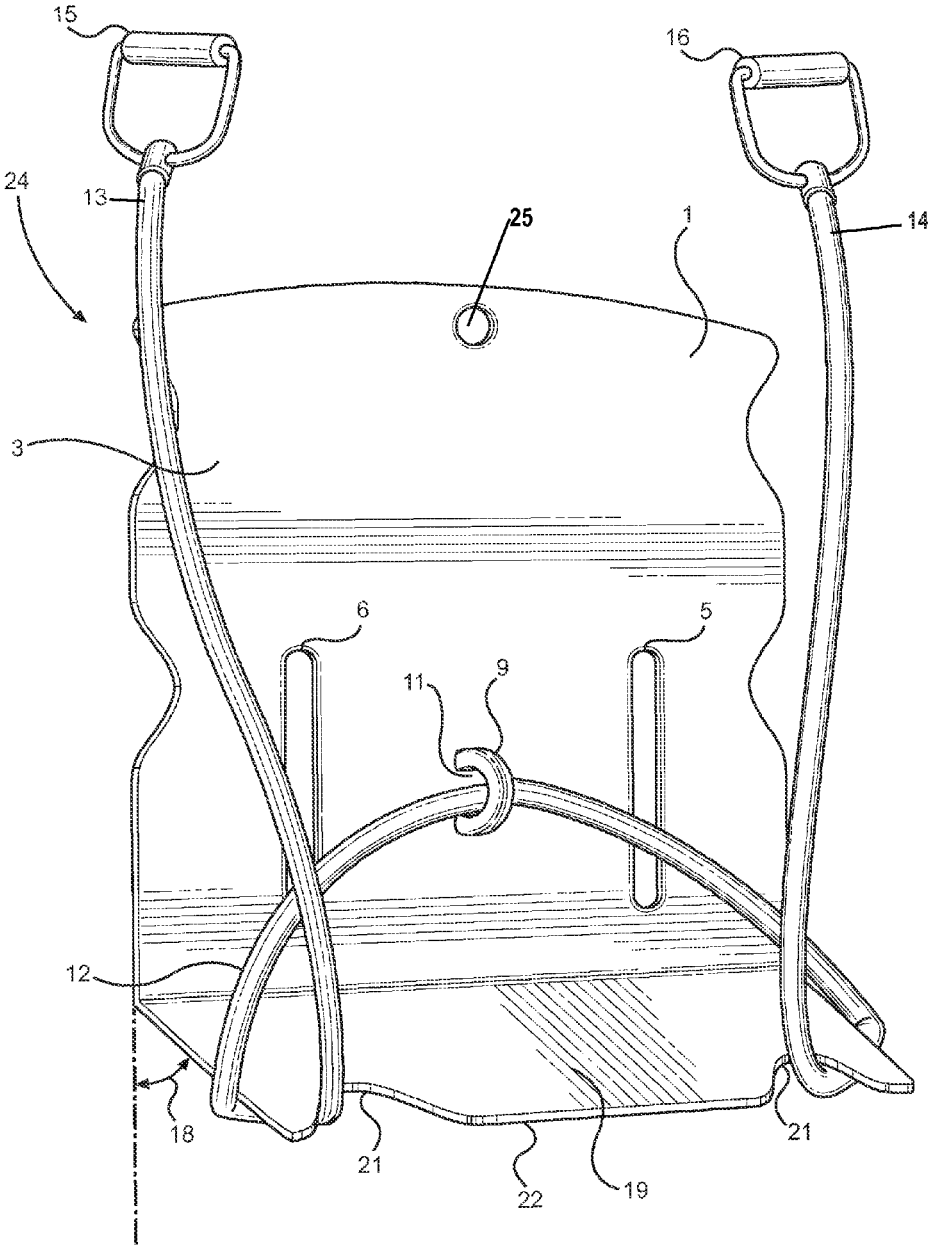

FIGS. 2, 3, 4, 5, 6, and 7 illustrate exercise apparatus 24 having back plate 1 with at least one recess 21 located on a perimeter 22 of plate 1. Secondary side 3 of plate 1 has at least one protruding structure 9 with opening 11 being substantially perpendicular 10 (FIGS. 5 and 6) when plate 1 is attached to user's torso 8 (FIGS. 5 and 6). Protruding structure 9 has opening 11 that receives pliable material 12 (FIGS. 2-7). Plate 1 has primary opening 5 and secondary opening 6. Plate 1 has at least one portion 19 flaring at an angle between 0 degrees and 60 degrees 18 (FIGS. 4 and 6-7) in relation to plate 1. FIGS. 2, 3, and 7 show plate 1 having opening 25 adapted to receive including, but not limited to, a wall hook, a nail, or a length of material (not shown).

Referring again to FIGS. 3, 5, and 6, securing strap 7 is received by primary opening 5 and secondary opening 6. Securing strap 7 has opening 20 to be received by at least one protruding structure 9. Referring again to FIG. 4, primary side 2 of plate 1 contacts user's back 4. Securing strap 7 is received by primary opening 5 and secondary opening 6. Securing strap 7 is configured to attach to user's torso 8. Pliable material 12 has primary end 13 with primary grip 15. Primary grip 15 is configured to be grasped by user's primary extremity 17A. Pliable material 12 has secondary end 14 with secondary grip 16. Secondary grip 16 is configured to be grasped by user's secondary extremity 17B.

FIGS. 5 and 6 depict securing strap 7 configured to attach to user's torso 8. Primary side 2 (not shown) contacts user's back 4. Pliable material 12 has primary end 13 with primary grip 15. Primary grip 15 is configured to be grasped by user's primary extremity 17A. Pliable material 12 has secondary end 14 with secondary grip 16. Secondary grip 16 is configured to be grasped by user's secondary extremity 17B. FIG. 5 shows the primary grip 15 and secondary grip 16 being a handle. FIG. 6 shows the primary grip 15 and secondary grip 16 being an end of pliable material 12.

These embodiments are illustrative of the invention and are not exhaustive thereof. As a user develops different exercise techniques, interchangeable resistance bands having differing resistance levels and differing lengths may be required in future embodiments of the invention but all such future embodiments are within the scope of this invention.

For example, a user practicing rehabilitation or physical therapy techniques can use a resistance band that has a light resistance. A light resistance corresponds with a resistance band that is easily stretched. An athlete can use a heavier resistance that corresponds to a more stiff resistance band. Also, different muscle groups can handle different resistance intensities. The leg and core muscles can use a heavier resistance while the muscles in the arms can use a lighter resistance. It is a preferred embodiment that a plurality of pliable materials (not shown) having differing resistance levels and differing lengths that can be interchangeable between users or muscle groups.

Construction of the Novel Exercise Mechanism

Referring now to FIG. 1, it will be seen that the reference numeral 24 denotes an illustrative embodiment of the novel exercise apparatus 24 as a whole. Novel exercise apparatus 24 has plate 1 with primary side 2 located opposite secondary side 3. Plate 1 has primary opening 5 and secondary opening 6 to receive securing strap 7. Securing strap 7 has an end located opposite another end. Fastener 23 is located on both ends of securing strap 7.

Referring again to FIG. 3, secondary side 3 has at least one protruding structure 9 having opening 11 being substantially perpendicular 10 when plate 1 is attached to user's torso (not shown). Pliable material 12 is inserted through opening 11 of at least one protruding structure 9. Referring now to FIG. 5, pliable material 12 has primary end 13 located opposite secondary end 14. Primary end 13 has primary grip 15 and secondary end 14 has secondary grip 16. Securing strap 7 has opening 20 to receive at least one protruding structure 9.

Referring to FIGS. 6-7, plate 1 has at least one portion 19 flaring at an angle between 0 degrees and 60 degrees 18 in relation to plate 1. Perimeter 22 of plate 1 has at least one recess 21.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. An exercise apparatus, comprising:

a plate, said plate having a first side located opposite a second side, said first side capable of being supported by a user's torso;

said plate having a first opening and a second opening, whereby, said first opening and said second opening receive a securing strap configured to secure said plate to said user's torso, whereby, said securing strap has an opening to receive said at least one protruding structure;

said second side of said plate comprising said at least one protruding structure, said at least one protruding structure having an opening, said opening being substantially perpendicular to said user's torso when said plate is secured to said user's torso, whereby, said opening receives a pliable material;

said pliable material having a first end located opposite a second end, said first end having a first grip and said second end having a second grip, said first grip configured to be contacted by a user's first extremity and said second grip configured to be contacted by a user's second extremity; and, said pliable material capable of having a length great enough for said user's first extremity to contact said first grip and said user's second extremity to contact said second grip when said first side of said plate is supported by said user's torso.

2. The exercise apparatus of claim 1, wherein said plate having at least one portion, said at least one portion flaring at an angle between 0 degrees and 60 degrees in relation to said plate.

3. The exercise apparatus of claim 1, further comprising said plate having at least one recess, said at least one recess located on a perimeter of said plate.

* * * * *